US006475053B1

(12) United States Patent
Liu

(10) Patent No.: US 6,475,053 B1
(45) Date of Patent: Nov. 5, 2002

(54) CRAB-SHAPED BUILT-UP TOY

(76) Inventor: Kuo-Ching Liu, 5Fl, No 1, Alley 11, Lane 1, Sec. 1, Yunhan S. Rd, Lujou City, Taipei (TW), 247

( * ) Notice: Subject to any disclaimer, the term of this patent is extended or adjusted under 35 U.S.C. 154(b) by 0 days.

(21) Appl. No.: 09/951,975

(22) Filed: Sep. 14, 2001

(51) Int. Cl.[7] ..... A63H 3/10
(52) U.S. Cl. ..... 446/97; 446/387
(58) Field of Search ..... 446/85, 97, 101, 446/105, 368, 387, 388, 390, 391

(56) References Cited

U.S. PATENT DOCUMENTS 2,365,098 A * 12/1944 Nudelman ..... 446/376
4,526,553 A * 7/1985 Guerrero ..... 446/380
5,458,521 A * 10/1995 Todd ..... 229/116.3

FOREIGN PATENT DOCUMENTS

GB 2030462 * 4/1980

* cited by examiner

*Primary Examiner*—Jacob K. Ackun
(74) *Attorney, Agent, or Firm*—Troxell Law Office PLLC

(57) ABSTRACT

A crab-shaped toy is built up from a plurality of modeled parts including a main body part, two claw parts, and a plurality of leg parts. All these modeled parts are connected to one another through engagement of slits provided thereon and thereby form a three-dimensional toy crab. These parts are also provided with patterns showing specific features that are usually found on a real crab, so that the assembled toy crab is vivid to attract more players and helps players to know more things about the crab.

1 Claim, 2 Drawing Sheets

CRAB-SHAPED BUILT-UP TOY

FIELD OF THE INVENTION

The present invention relates to a crab-shaped toy, and more particularly to a crab-shaped toy built up from a plurality of modeled parts, so that a player learns more things about the crab from assembling the modeled parts.

BACKGROUND OF THE INVENTION

The built-up toy is presently one of the most welcomed toys among children. It enables a player to enjoy the pleasure of assembling different parts into an embodied toy through thinking and imagination.

The currently available built-up toys are generally divided into two types, namely, modularized built-up toys and imitative built-up toys. A modularized built-up toy usually includes a plurality of modules that have a uniform shape, such as round, polygonal modules and the like. An imitative built-up toy usually has an appearance imitating or converted from a real thing in our life, such as some kind of animal or mechanical structure, and includes a plurality of modeled parts that representing different and distinct areas featuring the real thing being imitated.

The modules included in a modularized built-up toy could be freely assembled to one another completely through a player's creative ideas. The player may freely build up various kinds of predefined or imaginary figures from the uniform modules. However, from the standpoint of helping a player, particularly a child, to understand the structure of a real thing from assembling of the built-up toy, the imitative built-up toys would be a preferred choice.

In the production of conventional imitative built-up toys, the imitated items are usually roughly divided into only a few major parts. Therefore, the imitative toys built up from these parts do not present overall appearances and particulars as close as possible to the real things being imitated. That is, there is a considerable difference between the toys built up from the roughly divided parts and the real things being imitated. Thus, the assembled toys do not enable the players to have an idea about the exact three-dimensional configurations of the real things being imitated.

Moreover, the conventional built-up toys are usually made to a rather small scale to the real things. This condition and still many other factors prevent the imitative built-up toys from showing more detailed features of the real things to attract and educate players.

SUMMARY OF THE INVENTION

It is therefore a primary object of the present invention to provide an improved built-up toy that eliminates the drawbacks existing in the conventional imitative built-up toys so as to present a three-dimensional body and more distinct features of a real thing being imitated.

In an embodiment of the present invention, a crab-shaped built-up toy is provided. The toy includes a plurality of modeled parts separately representing distinct areas of a real crab and having patterns painted thereon to show features of the crab. These modeled parts are connectable to one another through tight-fitting slits provided thereon, so that an attractive three-dimensional toy crab is formed.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
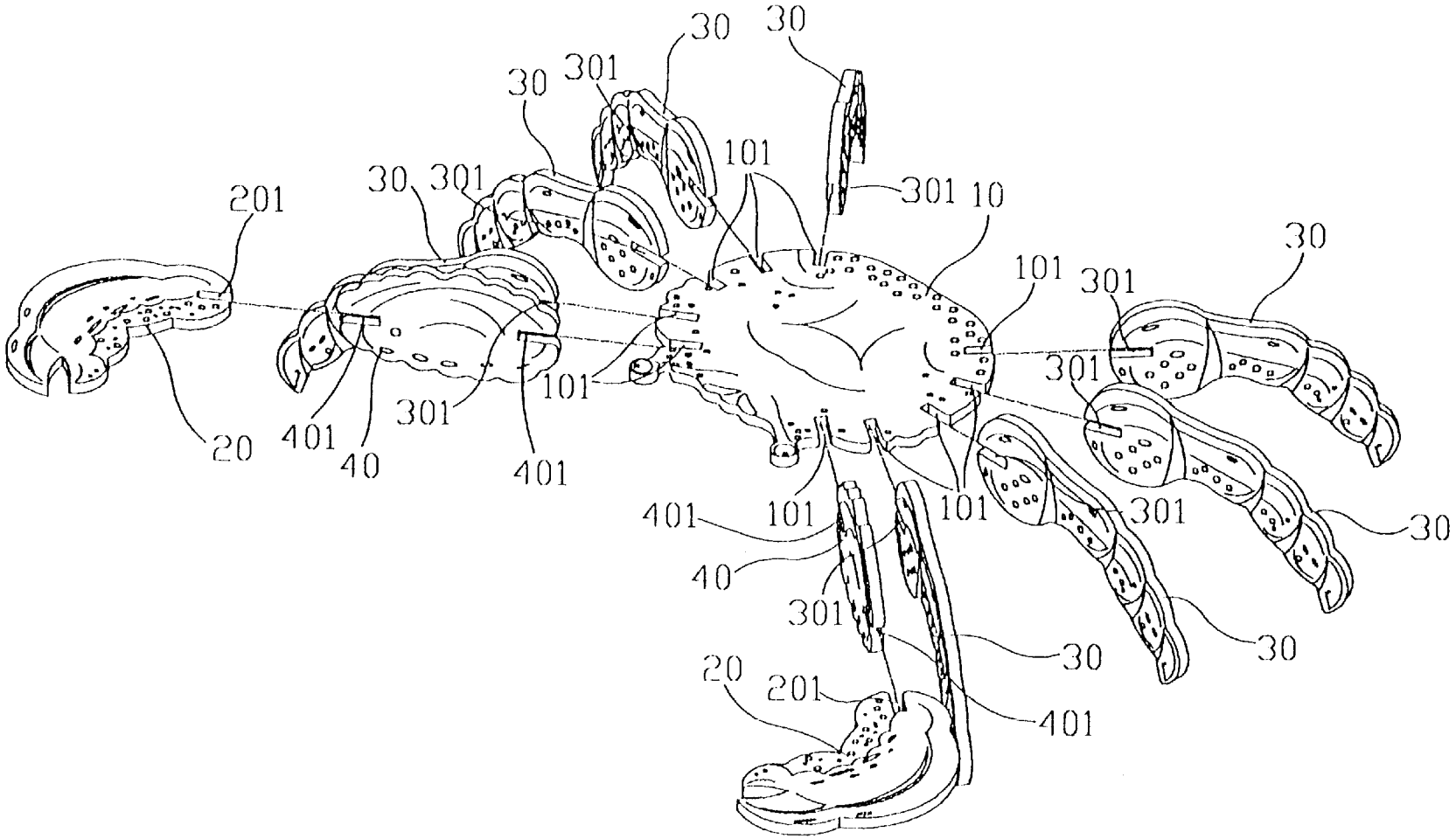
FIG. 1 is an exploded perspective view of a crab-shaped built-up toy according to an embodiment of the present invention.

Please refer to FIG. 1 that is an exploded perspective view of a crab-shaped built-up toy according to an embodiment of the present invention. As shown in FIG. 1, the crab-shaped toy is built up from a plurality of modeled parts that generally represent some specific and featuring areas of a crab. These modeled parts mainly include a main body part 10, two claw parts 20, and a plurality of leg parts 30.

The main body part 10 is a flat member substantially showing a body of a crab and being correspondingly provided at two lateral sides with a plurality of first slits 101.

Each of the two claw parts 20 is a flat member substantially showing the shape of a claw of a crab and being provided at a predetermined position with a second slit 201 for engaging with one of the first slits 101 on the main body part 10.

Each of the leg parts 30 is a flat member substantially showing the shape of a leg of a crab and being provided at a predetermined position with a third slit 301 for engaging with one of the first slits 101 on the main body part 10.

Figure 2:
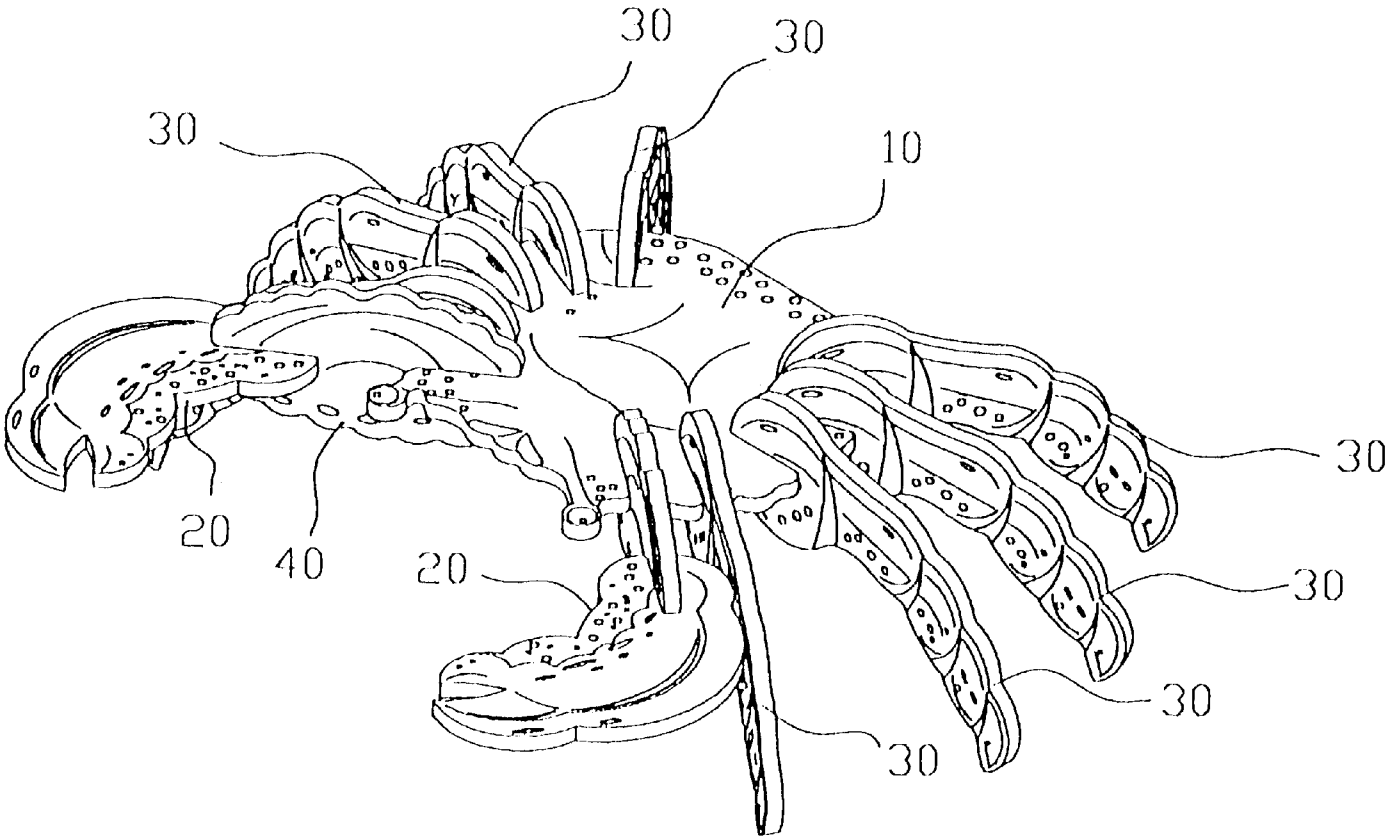
FIG. 2 is a fully assembled perspective view of the crab-shaped built-up toy of FIG. 1.

With the above arrangements, it is possible to directly connect the claw parts 20 to the main body part 10 through engagement of the second slits 201 with the first slits 101. Alternatively, each of the claw parts 20 may be indirectly connected to the main body part 10 via an interconnecting part 40, as shown in FIGS. 1 and 2. Each of the interconnecting parts 40 is provided at predetermined positions with two fourth slits 401 adapted to separately engage with the first and the second slits 101 and 201, so as to connect the main body part 10 to the claw parts 20. In brief, the main body part 10, the claw parts 20, the leg parts 30, and the interconnecting parts 40 could be assembled into a crab-shaped toy through engagement of the slits 101, 201, 301, and 401 with one another, as shown in FIG. 2.

A player may connect the parts 10, 20, 30 and 40 to one another step by step in accordance with the following instructions:

1. Connect the leg parts 30 and the interconnecting parts 40 to two lateral sides of the main body part 10 by engaging the third slits 301 on the leg parts 30 and one of the two fourth slits 401 on each interconnecting part 40 with the first slits 101 one by one, so that the interconnecting parts 40 are located at the two most front first slits 101; and
2. Connect the two claw parts 20 to the two interconnecting parts 40 through engagement of the second slit 201 on each claw part 20 with another fourth slit 401 on each interconnecting part 40, so that the claw parts 20 are horizontally located at outer sides of the interconnecting parts 40.

The assembled modeled parts together form a three-dimensional crab-shaped toy, as shown in FIG. 2. The modeled parts generally present a full configuration as well as many particular areas of the crab. However, to present the crab as real as possible, each of the modeled parts 10, 20, 30 and 40 may be painted to show specific patterns that are usually found on the crab.

Thus, the built-up toy of the present invention not only shows an overall appearance of the crab but also many particular areas thereof for a player to know more things about the crab.

Further, to enable firm connection of the main body part 10, the claw parts 20, the leg parts 30, and the interconnecting parts 40 to avoid undesired separation of them from one another at the engaged slits, all the slits 101, 201, 301, and 401 are designed to engage with one another in a tight-fit relation.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A crab-shaped, built-up toy comprising:

a) a main body of planar configuration, the main body having two opposite side edges, each side edge having a plurality of body slits;

b) a plurality of legs, each having a planar configuration and one end with a leg slit, each leg slit engaged with one of the plurality of body slits to immovably attach the legs to the opposite side edges of the main body such that planes of the legs are perpendicular to a plane of the main body;

c) two interconnecting parts, each interconnecting part having a planar configuration, and first and second interconnecting slits therein, the first interconnecting slit engaging one of the plurality of body slits to immovably attach the interconnecting parts to the main body such that planes of the interconnecting parts are perpendicular to the plane of the main body; and, d) two claw parts, each claw part having a planar configuration and a claw slit therein, the claw slits engaging the second interconnecting slits to immovably attach the claw parts to the interconnecting parts.

* * * * *